United States Patent [19]

Mazzilli

[11] 4,194,356

[45] Mar. 25, 1980

[54] THERMO WRIST WATCH

[76] Inventor: Nick Mazzilli, 7540 Garnier St., Apt. 3, Montreal, Quebec, Canada

[21] Appl. No.: 889,562

[22] Filed: Mar. 23, 1978

[51] Int. Cl.[2] ..... G04B 47/06

[52] U.S. Cl. ..... 368/11; 368/232

[58] Field of Search ..... 58/152 R, 152 A, 127 B; 73/368

[56] References Cited

U.S. PATENT DOCUMENTS

| | | | |
|---|---|---|---|
| 370,400 | 9/1887 | McLean | 58/152 A |
| 2,763,122 | 9/1956 | Hayes | 58/152 A |
| 3,177,718 | 4/1965 | Stevenson | 58/152 A |
| 3,253,466 | 5/1966 | Chough | 58/152 R |

*Primary Examiner*—B. Dobeck
*Assistant Examiner*—William L. Feeney
*Attorney, Agent, or Firm*—Melvin Sher; Alan Swabey; Robert Mitchell

[57] ABSTRACT

The invention relates to a wrist watch and thermometer arrangement. The thermometer is carried in a channel which surrounds the dial face of the watch, and the channel is formed by a platform, surrounding the dial face and disposed on one side of the thermometer, and a removable member, disposed on the other side of the thermometer. Hold down means, consisting of thin strips of a material having spring-like characteristic, extend over the thermometer from the removable means towards the platform. To remove the thermometer, it is merely necessary to lift the removable means off the platform. The removable means may be attached to the platform by a plurality of screws. The thermometer is carried in the channel by a plurality of y-shaped stands, at least the top portions of which are made of an insulating material.

10 Claims, 4 Drawing Figures

THERMO WRIST WATCH

BACKGROUND OF THE INVENTION

1. Statement of the Invention

This invention relates to a wrist watch and thermometer arrangement. More specifically, this invention relates to such an arrangement wherein the thermometer element surrounds the dial face.

2. Statement of the Prior Art

It is known in the art to provide wrist watch and thermometer arrangements. However, in the known arrangements, the thermometer is disposed at the side of the dial face, and such a thermometer is very small, difficult to read, and of doubtful accuracy. In addition, its appearance is not very attractive and it tends to be rather cumbersome.

SUMMARY OF THE INVENTION

It is therefore an object of the invention to provide a wrist watch and thermometer arrangement which overcomes the deficiencies of the prior art arrangements.

It is a more specific object of the invention to provide such an arrangement wherein the thermometer surrounds the dial face.

It is an even more specific object of the invention to provide a structure whereby a thermometer may be incorporated into a wrist watch and thermometer arrangement.

It is an even more specific object of the invention to provide such an arrangement wherein the thermometer is easily and conveniently removable for cleaning or repair as required.

In accordance with an embodiment, a watch and thermometer arrangement, comprises:

a dial face;

means, for carrying a thermometer, surrounding said dial face; and a thermometer mounted in said means for carrying a thermometer.

The thermometer is preferably removably mounted in said means for carrying a thermometer.

The means for carrying a thermometer preferably comprises a channel surrounding said dial face.

The channel may be formed by a platform surrounding said dial face and disposed on one side of said thermometer; and a removable member disposed on the other side of said thermometer.

The arrangement may further comprise a plurality of screw holes in said platform;

a like plurality of aligned screw holes in said removable member; and a screw extending into each of said aligned holes;

whereby said removable member is removably connected to said platform.

The arrangement may still further comprise a plurality of hold down means on said removable means and extending over said thermometer from said removable means to said platform.

The hold down means may comprise a thin strip of a material having spring-like characteristics.

The thermometer may be mounted on a plurality of y-shaped stands in said channel, and each said y-shaped stand is disposed under a different hold down means.

BRIEF DESCRIPTION OF THE DRAWINGS

The invention will be better understood by an examination of the following description, together with the accompanying drawings, in which.

DETAILED DESCRIPTION OF THE DRAWINGS

Figure 1:
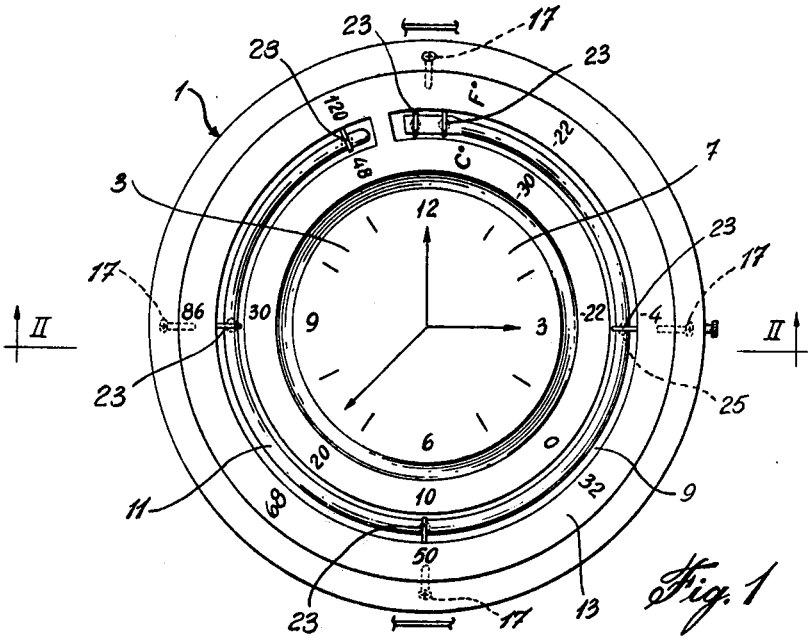
FIG. 1 is a plan view of one embodiment of the invention.
Figure 2:
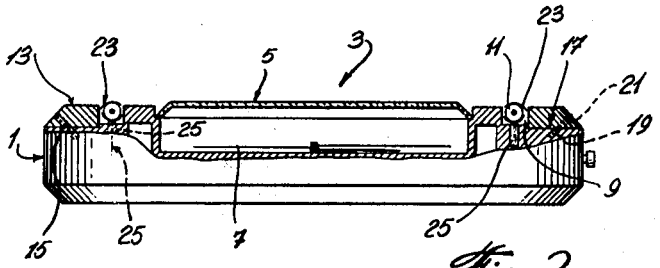
FIG. 2 is a section through II–II in FIG. 1.

Referring to FIGS. 1 and 2, the arrangement, indicated generally at 1, includes the dial face 3, which, in common with all watches, comprises a crystal 5 and the dial portion 7. Surrounding the dial face is a means 9, such as a channel for carrying thermometer 11. A removable member 13, mounted on platform 15, surrounds the thermometer and provides structure to permit convenient and easy removal of the thermometer for cleansing or repair as required. The channel is formed by the combination of the member 13 and platform 15.

Figure 3:
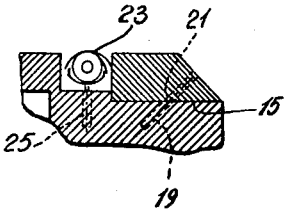
FIG. 3 is a detail drawing showing how the removable member is connected to the platform.

The removable member is connected to the platform by a plurality of screws 17. As seen in FIG. 1, in one embodiment there are four equally spaced such screws, however, as will be appreciated, more or less screws could be used as required. Referring to FIGS. 2 and 3, the screws are inserted in screwholes 19 and 21 in the platform and removable members respectively. The holes 19 line up with corresponding holes 21 so that screws 17 can pass through the two holes at each location, and either both holes 19 and 21 can contain threads for mating with the threads on screws 17, or only hole 19 may contain such threads.

Attached to the removable member 13, and extending across the channel 9, are a plurality of hold down means 23. Six such means are shown in FIG. 1, although more or less could be used. The hold down means are thin strips of a material having a spring-like quality, so that there will be a small amount of give on impact to avoid breaking the thermometer on impact as may be the case if they were completely rigid. The hold down means extend from one side edge of the removable member 13 in the direction of the platform 15. The strips should be thin enough to avoid obscuring the readings on the thermometer, or they could be made of a transparent material.

Figure 4:
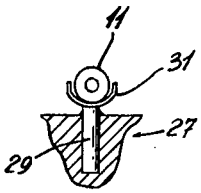
FIG. 4 is a detail drawing showing the y-shaped stand.

As best seen in FIGS. 3 and 4, the thermometer is carried in the channel 9 by a plurality of y-shaped stands 27. Each such stand includes a somewhat cylindrical vertical post 29, and a somewhat u-shaped cradle 31. The purpose of the y-shaped members is both to hold the thermometer in place and to insulate it from the case of the watch so that the thermometer readings will not be influenced by the effects of the surrounding metal. For this reason, at least the u-shaped cradles will be made of an insulating material.

The posts are inserted in sockets 25 in the platform 15, and such sockets are preferably disposed adjacent locations at which hold down means are disposed.

As best seen in FIG. 1, scale readings are included on the top surface of removable member 13, on one side of the thermometer, and on the top surface of platform 15, on the other side of the thermometer. In the preferred embodiment, one of the scales will be in degrees Fahrenheit and the other in degrees Celsius. Thus, the watch arrangement can also be conveniently used for learning conversion from Fahrenheit to Celsius.

To remove the thermometer, for cleansing or other purposes, it is merely necessary to unscrew the screws 17, and to remove the removable member 13. To replace the thermometer, it is first positioned on the y-shaped stands. The removable member 13 is then mounted on the platform 15, and it is adjusted so that holes 21 line up with corresponding holes 19. The screws 17 are then screwed into each of the holes 19–21.

Although an arrangement incorporating a round dial face has been illustrated, it will, of course, be apparent that the invention can also be implemented with dial faces of different shapes. In such cases, either the shape of the thermometer would be altered, or the circular shape would be maintained and the diameter of the circular shaped thermometer would be made great enough to completely encompass and surround the non-circular shaped dial face.

In any case, the arrangement is not cumbersome; is attractive in appearance; and is of a size whereby the scales can be easily read by a person with normal eyesight. Nevertheless, a magnifying glass could overlie the scales to improve readability.

Although a specific embodiment has been described, this was for the purpose of illustrating, but not limiting, the invention. Various modifications, which come readily to the mind of one skilled in the art, are within the scope of the invention as defined in the appended claims.

I claim:

1. A watch and thermometer arrangement, comprising:

a dial face having a crystal covering;

means, for carrying a thermometer, comprising a channel, outside of said crystal cover, surrounding said dial face;

a thermometer mounted in said means for carrying a thermometer;

said thermometer being mounted on a plurality of spaced y-shaped stands in said channel;

each said y-shaped stand comprising a vertical post and a u-shaped cradle mounted at one end of the vertical post;

the thermometer being carried in the cradles of the y-shaped stands;

at least the cradle of each y-shaped stand being made of an insulating material.

2. An arrangement as defined in claim 1 wherein said thermometer is removably mounted in said means for carrying a thermometer.

3. An arrangement as defined in claim 2 wherein said channel is formed by a platform surrounding said dial face and disposed on one side of said thermometer; and a removable member disposed on the other side of said thermometer.

4. An arrangement as defined in claim 3 and further comprising:

a plurality of screw holes in said platform;

a like plurality of aligned screw holes in said removable member; and a screw extending into each of said aligned holes;

whereby said removable member is removably connected to said platform.

5. An arrangement as defined in claim 4 and further comprising a plurality of hold down means on said removable means and extending over said thermometer from said removable means to said platform.

6. An arrangement as defined in claim 5 wherein each said hold down means comprises a thin strip of a material having spring-like characteristics.

7. An arrangement as defined in claim 6 wherein each said y-shaped stand is disposed under a different hold down means.

8. An arrangement as defined in claim 1 and comprising a plurality of sockets, equal to said plurality of y-shaped stands, in said platform;

each vertical post of said y-shaped stands being disposed in a different one of said sockets.

9. An arrangement as defined in claim 1 wherein said thermometer is circular in shape.

10. An arrangement as defined in claim 7 wherein said thermometer is circular in shape.

* * * * *